United States Patent [19]

Romey et al.

[11] 4,231,856

[45] Nov. 4, 1980

[54] PURIFYING FILTER-CLOGGING COAL TAR FORMED FROM LOW-TEMPERATURE COAL CARBONIZATION

[75] Inventors: Ingo Romey, Hünxe; Hellmüt Kokot, Essen, both of Fed. Rep. of Germany

[73] Assignee: Bergwerksverband GmbH, Essen, Fed. Rep. of Germany

[21] Appl. No.: 17,134

[22] Filed: Mar. 5, 1979

Related U.S. Application Data

[63] Continuation of Ser. No. 845,454, Oct. 25, 1977, abandoned, which is a continuation of Ser. No. 682,171, Apr. 30, 1976, abandoned.

[30] Foreign Application Priority Data

May 13, 1975 [DE] Fed. Rep. of Germany ..... 2521117

[51] Int. Cl.[2] ..... C10C 1/00

[52] U.S. Cl. ..... 208/39; 208/45

[58] Field of Search ..... 208/39, 45

[56] References Cited

U.S. PATENT DOCUMENTS

| | | | |
|---|---|---|---|
| Re. 25,467 | 10/1963 | Logan et al. | 208/39 |
| 1,589,374 | 6/1926 | Dietzsch | 208/39 |
| 2,631,982 | 3/1953 | Donegan | 208/39 |
| 2,683,107 | 7/1954 | Juel | 208/39 |
| 3,992,281 | 11/1976 | Benade | 208/39 |
| 4,073,728 | 2/1978 | Ullrich et al. | 208/39 |

*Primary Examiner*—Veronica O'Keefe

*Attorney, Agent, or Firm*—Michael J. Striker

[57] ABSTRACT

A process is provided for purifying filter-clogging coal tar residue of the type obtained by low-temperature carbonization of coal. Such coal tar residues include viscous organic coal tar constituents, particulate solid impurities and liquid water. Applicants' process includes the step of heating coal at 450°–700° C. at least substantially in the absence of air to thereby decompose the coal to products including coal tar, the coal tar being of the type containing liquid water, particulate solid impurities, and viscous organic coal tar constituents including light oils, the light oils incidentally combining with the liquid water to produce a filter-clogging emulsion. The thus-formed coal tar is then heated to a temperature above the boiling point of water and sufficiently high to thereby distill off substantially all of the water and the light oils to thereby obtain an intermediate product which is substantially free from the presence of liquid water and light oil constituents which in combination form a filter-clogging emulsion. Finally, the intermediate product is subsequently filtered to thereby separate the particulate solid impurities from the undistilled viscous constituents of the coal tar.

8 Claims, No Drawings

PURIFYING FILTER-CLOGGING COAL TAR FORMED FROM LOW-TEMPERATURE COAL CARBONIZATION

CROSS-REFERENCE TO RELATED APPLICATION

This application is a continuation of application Ser. No. 845,454, filed Oct. 25, 1977 and now abandoned which in turn was a continuation of application Ser. No. 682,171, filed Apr. 30, 1976 and now abandoned.

BACKGROUND OF THE INVENTION

The invention relates generally to the treatment of tar. Of particular interest to the invention is the purification of tar, especially tar obtained from low-temperature carbonization processes.

When using the newer technologies which have been developed in the area relating to the gasification and combustion of bituminous coal such as, for instance, gasification under pressure and related processes, there are obtained tars which have compositions differing substantially from those of the bituminous coal tars yielded during the coking of bituminous coal.

These tars, that is, the tars derived when using the newer technologies, are also obtained in relatively large quantities from bituminous coal during processes which are carried out at maximum temperatures of 600° to 700° C. For this reason, such tars will also be referred to hereinafter as low-temperature carbonization tars.

An upgrading or purification of low-temperature carbonization tars with the known methods of the coking art, such as those involving decantation of the water and subsequent distillation, is not possible. In particular, the known methods of the coking art cannot be used to upgrade or purify low-temperature carbonization tar by removing impurities such as mineral constituents, ashes, coal particles, coke particles and carbon black particles which are present in solid form. Thus, low-temperature carbonization tars have only a small proportion, that is, about 15 to 30 percent, of distillable constituents whereas the proportion of distillable constituents in the bituminous coal tars obtained from coking plants is between about 45 and 50 percent. Moreover, as a result of the different conditions under which they are formed as opposed to bituminous coal tars, the low-temperature carbonization tars have a high proportion of organic and inorganic impurities as well as a high water content.

Even a combustion of the crude low-temperature carbonization tars cannot be carried out due, in particular, to their high ash contents.

SUMMARY OF THE INVENTION

One object of the invention is to provide a novel process for the purification or upgrading of tars.

Another object of the invention is to provide an economical manner by which the low-temperature carbonization tars outlined above, which are generated in large quantities as a by-product, may be upgraded and utilized.

These objects, as well as others which will become apparent as the description proceeds, are achieved in accordance with the invention. According to one aspect of the invention, there is provided a process for the purification or upgrading of tars wherein at least the predominant part of the water contained in a tar is removed therefrom. Thereafter, the tar is filtered.

According to one embodiment of the invention, at least the predominant part of the constituents of the tar which is emulsified in the water are also removed from the tar prior to the filtration of the tar.

According to another embodiment of the invention, it is contemplated to subject the tar to a mechanical action during the removal of the water from the tar. Such a mechanical action may involve stirring the tar or subjecting the tar to a squeezing action such as, for instance, by kneading the tar. It is also possible to both stir the tar and subject the tar to a squeezing action.

DESCRIPTION OF THE PREFERRED EMBODIMENTS

Of particular interest to the invention is the treatment coal tar obtained from low-temperature carbonization. As mentioned above, such tar might, for example, be obtained during the low-temperature treatment of coal, especially bituminous coal, at temperatures below about 700° C. As defined by the *Condensed Chemical Dictionary*, Eighth Edition, Van Nostrand Reinholt Company, the term "low-temperature carbonization" means the destructive distillation of coal at relatively low temperatures, "destructive distillation" being further defined as the decomposition of a material by heat in the complete or almost complete absence of air, and simultaneous distillation of the volatile product. *Hackh's Chemical Dictionary*, Fourth Edition, McGraw-Hill, supplies the temperature range of this destructive distillation under the entry "carbonization, low temperature": 450°–700° C. *The Condensed Chemical Dictionary* notes that the purpose of low-temperature carbonization is to produce the greatest possible yield of liquid products with relatively small proportions of gases.

A process according to the invention includes the operations of removing at least the predominant part of the water contained in a tar therefrom and thereafter filtering the tar. Advantageously, the tar is substantially freed from water.

Favorably, the operation of removing water from the tar will also involve removal of at least the predominant part of the tar constituents which are emulsified in the water. Again, it is advantageous for the tar to be substantially freed of the constituents which are emulsified in the water.

The removing operation may involve distillation of the water contained in the tar as well as distillation of the tar constituents which are emulsified in the water. Thus, the tar may be subjected to a thermal treatment at temperatures which are preferably between 100° and 160° C.

The thermal treatment is favorably carried out at subatmospheric pressures. Preferably, the pressure during the thermal treatment is between 5 and 100 mm Hg. Atmospheric pressure is 760 mm Hg. It is particularly advantageous, however, for the pressure during the thermal treatment to be in the range of 15 to 30 mm Hg.

The thermal treatment is normally carried out for a period of 5 to 80 minutes.

It is preferred for the tar to be subjected to a mechanical action during the thermal treatment. As mentioned previously, such mechanical action might involve stirring the tar, subjecting the tar to a squeezing action such as is achieved by kneading the tar or both stirring the tar and subjecting the tar to a squeezing action.

The filtration of the tar subsequent to the thermal treatment is advantageously carried out at superatmospheric pressures. The pressures used for the filtration are preferably between 2 and 10 bars. It is particularly favorable, however, for the filtration to be effected at pressures between 3 and 5 bars.

It is further advantageous for the filtration to be carried out at elevated temperatures, the preferred temperatures being in the range of 120° to 220° C.

According to a particularly favorable embodiment of the invention, the objects of the invention are achieved with a method for the purification of low-temperature carbonization tars wherein crude, low-temperature carbonization tar is first freed from water and tar constituents which are emulsified therein by a thermal treatment at temperatures between 100° and 160° C. The thermal treatment is carried out at pressures between 5 and 100 mm Hg and, preferably, at pressures between 15 and 30 mm Hg, for a period of 5 to 80 minutes while stirring the tar and/or subjecting the tar to a squeezing action such as is achieved by kneading. After the thermal treatment, the tar is filtered under pressure and at temperatures between 120° and 220° C.

For a better understanding of the invention, it may be pointed out that it has been surprisingly found that only after the low-temperature carbonization tar has been freed from water is it possible to carry out a filtration under pressure at a satisfactory rate. The purified tar thus obtained may be directly used as refined tar or may, in known manner, be readily further upgraded or purified by distillation.

The filtering times required when the treatment of the invention is not used are long. The long filtering times necessary when the treatment of the invention is not used may be explained in that tar constituents combine with the water contained in the low-temperature carbonization tar to form an emulsion which blocks the pores or openings of the filter. In contrast, detrimental emulsions are no longer present in low-temperature carbonization tar which has been treated in accordance with the invention.

In connection with the filtration of the tar, it is advantageous when, after the thermal treatment, the low-temperature carbonization tar is admitted to the filter while it is still hot.

It will be self-understood that filter aids may be employed for the filtration of the tar. However, it may be pointed out that a filter cake continuously forms on the filter surface and that this filter cake automatically serves as a filter aid. This filter cake has approximately the following analytical composition:

| | | | |
|---|---|---|---|
| C | 68.3% waf | S | 2.4% waf |
| H | 1.54% waf | Cl | 0.95% waf |
| N | 0.55% waf | O | 1.6% waf |
| | Ashes | 24.66% | |

"waf" stands for water-free ash-free basis

As indicated earlier, it is possible for the filtered low-temperature carbonization tar to subsequently be further purified or upgraded by distillation. When this is done, pitch having a high carbon content is obtained as a residue. This pitch has approximately the following composition:

| | | | |
|---|---|---|---|
| C | 86.7% waf | S | 0.70% waf |
| H | 6.07% waf | Cl | 0.06% waf |

-continued

| | | | |
|---|---|---|---|
| N | 1.52% waf | O | 4.8% waf |

The following Examples are intended solely to further illustrate the invention and are not to be construed as limiting the invention in any manner:

EXAMPLE 1

A crude tar derived from the gasification of coal under pressure has the following composition:

| | | Weight Percent |
|---|---|---|
| Light Oil | Boiling Point: up to 180° C. | 0 |
| Medium Oil | Boiling Point Range: 180°-230° C. | 2.4 |
| Heavy Oil | Boiling Point Range: 230°-270° C. | 6.4 |
| Anthracene Oil | Boiling Point Range: 270°-350° C. | 7.2 |
| Water | | 11.8 |
| Ash | | 3.7 |
| Distillation Residues | | 68.5 |

This low-temperature carbonization tar is heated to 104° C. while stirring and retained at this temperature for a period of 50 minutes. A vacuum of 25 mm Hg is applied during the thermal treatment and about 12 weight percent of the low-temperature carbonization tar is distilled off in the form of an aqueous emulsion during the treatment period.

When the thus-treated low-temperature carbonization tar is placed in a pressure filter and filtered at a temperature of 180° C. and a pressure of 3 bars, a throughput capacity of 1.5 tons* of tar filtrate per square meter of filter surface per hour is obtained. This throughput capacity can be further increased if the thickness of the filter cake is maintained at less than 30 millimeters during the filtration by using suitable means for this purpose.

*1 t=1000 kg

If, for comparative purposes, the same crude tar is placed directly in the pressure filter without subjecting it to the thermal treatment, a throughput capacity of only 300 kilograms of tar filtrate per square meter of filter surface per hour is obtained under the same filtering conditions. By providing a layer of a filter aid such as, for example, kieselghur, having a thickness of 20 millimeters, the throughput capacity can be increased to a value of 320 kilograms of tar filtrate per square meter of filter surface per hour. However, even an increase in the filtering temperature and/or the filtering pressure yields no further significant increase in the throughput capacity.

EXAMPLE 2

A low-temperature carbonization tar derived from the low-temperature carbonization of bituminous coal has the following composition:

| | | Weight Percent |
|---|---|---|
| Light Oil | Boiling Point: 180° C. | 1.8 |
| Medium Oil | Boiling Point Range: 180°-230° C. | 9.8 |
| Heavy Oil | Boiling Point Range: 230°-270° C. | 10.4 |
| Anthracene Oil | Boiling Point Range: 270°-350° C. | 8.8 |
| Water | | 4.7 |
| Ash | | 2.8 |
| Distillation | | 71.6 |

-continued

| | Weight Percent |
|---|---|
| Residues | |

This low-temperature carbonization tar is pretreated at a temperature of 120° C. and a pressure of 10 torr for a period of about 45 minutes while stirring. During the treatment period, 6.3 weight percent of an aqueous emulsion are distilled off. This is about 97% of the sum of the liquid water and the light oil. When the thus-pretreated low-temperature carbonization tar is placed in a pressure filter and filtered at a temperature of 150° C. and a pressure of 5 bars, a throughput capacity of 1.3 tons of tar filtrate per square meter of filter surface per hour is obtained.

EXAMPLE 3

A crude tar having the composition outlined in Example 2 is conveyed through a continuously operating, elongated mixer such as, for instance, an extruder having a length of 1.20 meters, at a temperature of 150° C. The mixer is provided with a plurality of connections for the evacuation of gases. A vacuum of 20 mm Hg is applied to the connections. The low-temperature carbonization tar has a dwell time of about 5 minutes in the mixer and during this period 5.8 weight percent of an aqueous emulsion is sucked out through the connections. This is about 89% of the sum of the liquid water and light oils. After the treatment in the mixer, the low-temperature carbonization tar is placed in a filter and filtered under pressure. The filtration is carried out at a temperature of 120° C. and a pressure of 8 bars. A throughput capacity of 1.6 tons of tar filtrate per square meter of filter surface per hour is obtained during this pressure filtration.

It will be understood that each of the elements described above, or two or more together, may also find a useful application in other types of procedures and for substances differing from the types described above.

While the invention has been illustrated and described as embodied in a process for the purification of low-temperature carbonization tar, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A process for purifying filter-clogging coal tar residues of the type obtained by low-temperature carbonization of coal, and including viscous organic coal tar constituents, particulate solid impurities and liquid water, the process comprising the steps of heating coal at 450°–700° C. and at least substantially in the absence of air to thereby decompose the coal and obtain products including coal tar which contains liquid water, particulate solid impurities, and viscous organic coal tar constituents including light oils which tend to combine with the liquid water to produce a filter-clogging emulsion; heating the thus-formed coal tar to a temperature above the boiling point of water and sufficiently high to thereby distill off substantially all of the water and the light oils so as to obtain an intermediate product of increased viscosity and which is substantially free from the presence of liquid water and of the light oil constituents which in combination form the filter-clogging emulsion; and subsequently filtering the intermediate product without the use of a diluent to thereby separate the particulate solid impurities from the undistilled viscous constituents of the coal tar, the filtration without the use of a diluent being possible due to the elimination of light oils and water and the consequent absence of filter clogging which would otherwise result from the combination of the light oils with water onto a filter-clogging emulsion.

2. The process of claim 1, said step of heating the thus-formed coal tar being performed by heating the coal tar to between 100° and 160° C. while reducing the pressure to subatmospheric pressure between 5 and 100 mm Hg for a period of 5 to 80 minutes.

3. The process of claim 2, said step of heating the thus-formed coal tar being performed while reducing the pressure to a subatmospheric pressure of 15–30 mm Hg.

4. The process of claim 2, further comprising the step of stirring while heating the thus-formed coal tar.

5. The process of claim 2, said step of heating coal at 450°–700° C. being performed with bituminous coal.

6. The process of claim 2, said step of heating coal at 450°–700° C. producing a coal tar having particulate solid impurities comprising at least one member of the group consisting of mineral constituents, ashes, coal particles, coke particles and carbon black particles.

7. The process of claim 2, said step of filtering being performed under superatmospheric pressure.

8. The process of claim 7, said step of filtering being performed while heating the intermediate product to a temperature within the range of about 120°–220° C.

* * * * *